US008671712B2

(12) United States Patent
Noel et al.

(10) Patent No.: US 8,671,712 B2
(45) Date of Patent: Mar. 18, 2014

(54) UPPER FREEZER BASKET GUIDED BY LOWER FREEZER BASKET DIVIDER

(75) Inventors: Kevin L. Noel, Atkins, IA (US); Chad J. Rotter, Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 436 days.

(21) Appl. No.: 12/731,232

(22) Filed: Mar. 25, 2010

(65) Prior Publication Data

US 2011/0232322 A1 Sep. 29, 2011

(51) Int. Cl.
*F25D 25/00* (2006.01)

(52) U.S. Cl.
USPC ..... 62/465; 62/382; 62/440; 62/441; 312/401; 312/402; 312/404; 312/405.1; 312/330.1; 308/3.6; 308/3.8

(58) Field of Classification Search
USPC ..... 62/465, 382, 440, 441; 312/291, 301, 312/402, 401, 404, 405.1, 330.1, 122, 347, 312/348; 308/3.6, 3.8
See application file for complete search history.

(56) References Cited

U.S. PATENT DOCUMENTS

| | | | | |
|---|---|---|---|---|
| 3,371,796 | A | 3/1968 | Crouch et al. | |
| RE32,134 | E * | 5/1986 | Gutner et al. | 384/19 |
| 4,729,613 | A * | 3/1988 | Tromble et al. | 312/270.3 |
| 5,044,704 | A * | 9/1991 | Bussan et al. | 312/402 |
| 5,303,997 | A | 4/1994 | Kropf | |
| 5,918,959 | A * | 7/1999 | Lee | 312/404 |
| 5,980,009 | A | 11/1999 | Atalla et al. | |
| 6,253,568 | B1 * | 7/2001 | Peffley | 62/441 |
| 6,491,173 | B1 * | 12/2002 | Costa | 211/126.15 |
| 6,971,730 | B2 | 12/2005 | Koons | |
| 7,028,503 | B2 * | 4/2006 | Lyvers et al. | 62/344 |
| 7,159,415 | B2 | 1/2007 | Wood | |
| 7,168,578 | B2 * | 1/2007 | Mersch et al. | 211/41.8 |
| 7,228,704 | B2 | 6/2007 | Rand et al. | |
| 7,406,833 | B2 * | 8/2008 | Ertz et al. | 62/115 |
| 7,610,772 | B2 * | 11/2009 | Braun et al. | 62/344 |
| 7,628,461 | B2 * | 12/2009 | Carden et al. | 312/402 |
| 7,731,314 | B2 * | 6/2010 | Kim | 312/402 |
| 7,950,754 | B2 * | 5/2011 | Brown et al. | 312/402 |
| 7,997,667 | B2 * | 8/2011 | Rotter et al. | 312/402 |
| 8,029,081 | B2 * | 10/2011 | Oh | 312/402 |
| 8,141,968 | B2 * | 3/2012 | Velarde et al. | 312/402 |
| 8,152,255 | B2 * | 4/2012 | Nam et al. | 312/404 |
| 8,197,019 | B2 * | 6/2012 | Kim | 312/408 |
| 8,220,887 | B2 * | 7/2012 | Watts et al. | 312/402 |
| 8,231,190 | B2 * | 7/2012 | Ertz et al. | 312/402 |
| 2005/0160854 | A1 | 7/2005 | Rotter | |
| 2006/0017360 | A1 * | 1/2006 | Lyvers et al. | 312/404 |
| 2006/0022564 | A1 * | 2/2006 | Oh et al. | 312/402 |

(Continued)

FOREIGN PATENT DOCUMENTS

| | | | |
|---|---|---|---|
| JP | 04320785 A | * | 11/1992 |
| KR | 10-2009-0121583 | * | 11/2009 |

*Primary Examiner* — Frantz Jules
*Assistant Examiner* — Martha Tadesse

(57) ABSTRACT

A refrigerator includes a refrigerator cabinet, a fresh food compartment disposed within the refrigerator compartment, a freezer compartment disposed within the refrigerator cabinet, a freezer door for providing access to the freezer compartment, a lower freezer basket, an upper freezer basket, a divider operatively connected to the lower freezer basket to divide the lower freezer basket, and guide surfaces on a top portion of the divider to allow for guiding the upper freezer basket forward and back.

7 Claims, 4 Drawing Sheets

(56) References Cited

U.S. PATENT DOCUMENTS

| | | | | |
|---|---|---|---|---|
| 2006/0049731 | A1* | 3/2006 | Choi et al. | 312/330.1 |
| 2006/0066189 | A1* | 3/2006 | Bond et al. | 312/319.1 |
| 2006/0152118 | A1 | 7/2006 | Lee | |
| 2007/0018548 | A1* | 1/2007 | Ertz et al. | 312/402 |
| 2007/0144408 | A1* | 6/2007 | Rotter | 108/16 |
| 2007/0227180 | A1* | 10/2007 | Koons | 62/441 |
| 2008/0314067 | A1* | 12/2008 | Lee | 62/441 |
| 2009/0045713 | A1* | 2/2009 | Kunkle et al. | 312/402 |
| 2009/0064707 | A1* | 3/2009 | Smith et al. | 62/465 |
| 2009/0167130 | A1* | 7/2009 | Chellappan et al. | 312/402 |
| 2009/0189500 | A1* | 7/2009 | Brown et al. | 312/404 |
| 2009/0193836 | A1* | 8/2009 | Ertz et al. | 62/449 |
| 2009/0230832 | A1* | 9/2009 | Shin | 312/404 |
| 2011/0011121 | A1* | 1/2011 | Kim | 62/441 |
| 2011/0127896 | A1* | 6/2011 | Anderson et al. | 312/404 |
| 2011/0285266 | A1* | 11/2011 | Rotter et al. | 312/402 |
| 2012/0139402 | A1* | 6/2012 | Haidar et al. | 312/404 |

* cited by examiner

UPPER FREEZER BASKET GUIDED BY LOWER FREEZER BASKET DIVIDER

FIELD OF THE INVENTION

The present invention relates to refrigerators. More particularly, but not exclusively, the present invention relates to a wire basket configuration in a refrigerator.

BACKGROUND OF THE INVENTION

Pullout drawers in refrigerator cabinets, and in particular bottom mounted freezer drawers, in which the freezer is located at the bottom of the refrigerator while the fresh food compartment is located at the top of the refrigerator, are often used to increase versatility of storing a wide range of food items, and increasing the accessibility of items stored in the lower portion of the refrigerator cabinet. Wire baskets are commonly used for storage in bottom mount pullout drawer models. Conventionally, there is a lower basket extending with the drawer and an upper basket that is pulled out after the drawer has been extended. Unfortunately, this type of wire basket configuration tends to become skewed when pulled out, particularly when the horizontal force (i.e., the consumer pushing or pulling on the basket) is not centered. One solution for this poor travel characteristic is a rack and pinion system. The rack and pinion forces the basket to pull out parallel to the rack gears. However this system needs a multitude of parts such as spur gears, gear mounts, a drive shaft and stamped sheet metal parts which adds significant cost as well as providing additional opportunities for parts to fail. All of which is unnecessary for a wire basket. Therefore, what is needed is a refrigerator with an improved wire basket configuration.

BRIEF SUMMARY OF THE INVENTION

Therefore, it is a primary object, feature or advantage of the present invention to improve over the state of the art.

It is a further object, feature, or advantage of the present invention to provide a system for pull-out drawers in a refrigerator which reduces manufacturing costs.

It is a still further object, feature, or advantage of the present invention to provide a system for pull-out drawers in a refrigerator which limits the number of component parts.

Another object, feature, or advantage of the present invention is to provide a system for pull-out drawers in a refrigerator where the top basket is centrally supported.

Yet another object, feature, or advantage of the present invention is to provide a smooth operating upper basket for a refrigerator.

A further object, feature, or advantage of the present invention is to provide a simple means of aligning and maintaining the upper basket.

One or more of these and/or other objects, features, or advantages of the present invention will become apparent from the specification and claims that follow. No single embodiment need achieve all of these objects, features, or advantages.

According to one aspect of the present invention, a refrigerator has a freezer compartment disposed within. A freezer door provides access to the freezer compartment. A lower freezer basket and an upper freezer basket are located within the freezer compartment. A divider is operatively connected to the lower freezer basket to divide the lower freezer basket. The lower freezer basket's divider has guide surfaces on a top portion to allow for guiding the upper freezer basket forward and back. The upper freezer and lower freezer baskets may be wire form baskets. The top portion of the divider may be shaped as an "I" beam.

The upper freezer basket may have a first and a second lead-in bends for moving along the guide surface of the divider. The freezer compartment may have first and second channels on opposite ends for supporting the upper basket. The divider may be press fit to the lower basket. The guide surfaces may include a first guide surface and a second guide surface, each of the first guide surface and the second guide surface configured to accept a lead-in bend of the wireform basket. The divider may be centrally positioned within the lower freezer basket.

According to another aspect of the present invention, a refrigerator includes a refrigerator cabinet, a fresh food compartment disposed within the refrigerator cabinet, a freezer compartment disposed within the refrigerator cabinet, a lower freezer basket disposed within the freezer compartment, and an upper freezer basket disposed within the freezer compartment. Each of the lower freezer basket and the upper freezer basket may be wire formed. There is a divider operatively positioned within the lower freezer basket, guide surfaces on a top portion of the divider such that the divider supports the upper freezer basket and assists in guiding the upper freezer basket forward and back. The upper freezer basket may be a wire form basket having a first and a second lead-in bend for moving along the guide surface of the divider.

According to another aspect of the present invention, an assembly is configured for use in a freezer compartment of a refrigerator. The assembly may include a lower freezer basket, an upper freezer basket, a divider operatively connected to the lower freezer basket to divide the lower freezer basket, and guide surfaces on a top portion of the divider to allow for guiding the upper freezer basket forward and back.

Other aspects, features and details of the present invention can be more completely understood by reference to the following detailed description in conjunction with the drawings, and from the appended claims.

DETAILED DESCRIPTION OF THE PREFERRED EMBODIMENT

Figure 1:
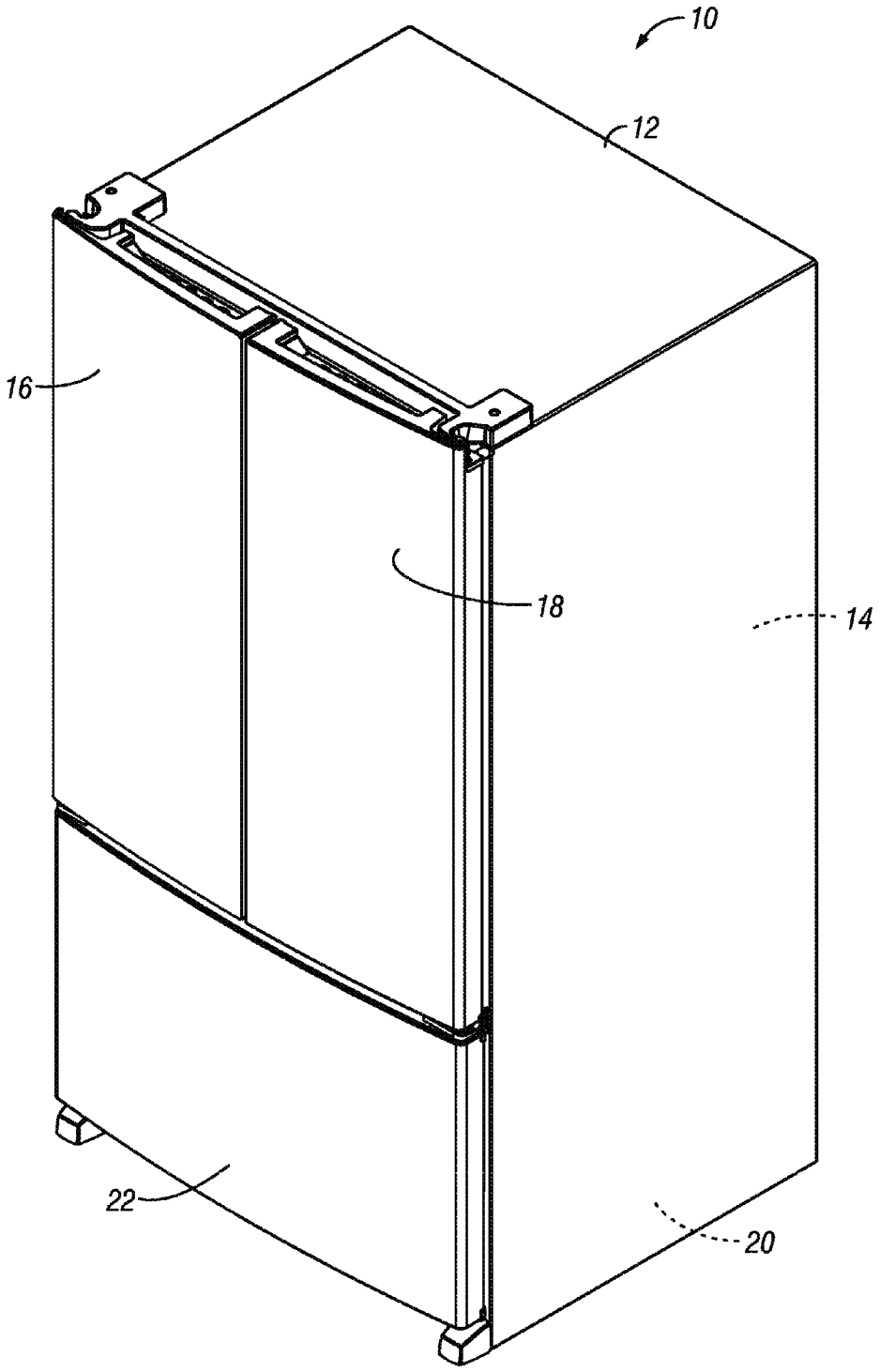
FIG. 1 is an isometric view of a bottom-mount style refrigerator showing an upper fresh food compartment and a lower freezer compartment.

Referring to the Figures, one embodiment of the present invention is shown in connection with a bottom mounted freezer of a refrigerator. In FIG. 1, a refrigerator 10 is shown. The refrigerator includes a refrigerator cabinet 12. There is a fresh food compartment 14 and a freezer compartment 20 disposed within the refrigerator cabinet 12. Fresh food compartment doors 16, 18 provide access to the fresh food compartment 14. A pullout drawer 22 is used to access the freezer compartment 20. The refrigerator 10 is a bottom-mount style refrigerator. The freezer drawer 22 may be mounted on slides, rack and pinion or systems incorporating both for opening same. While a bottom-mount refrigerator is shown, the invention is adaptable to any suitable refrigerator system, appliance system, or cabinet system.

Figure 2:
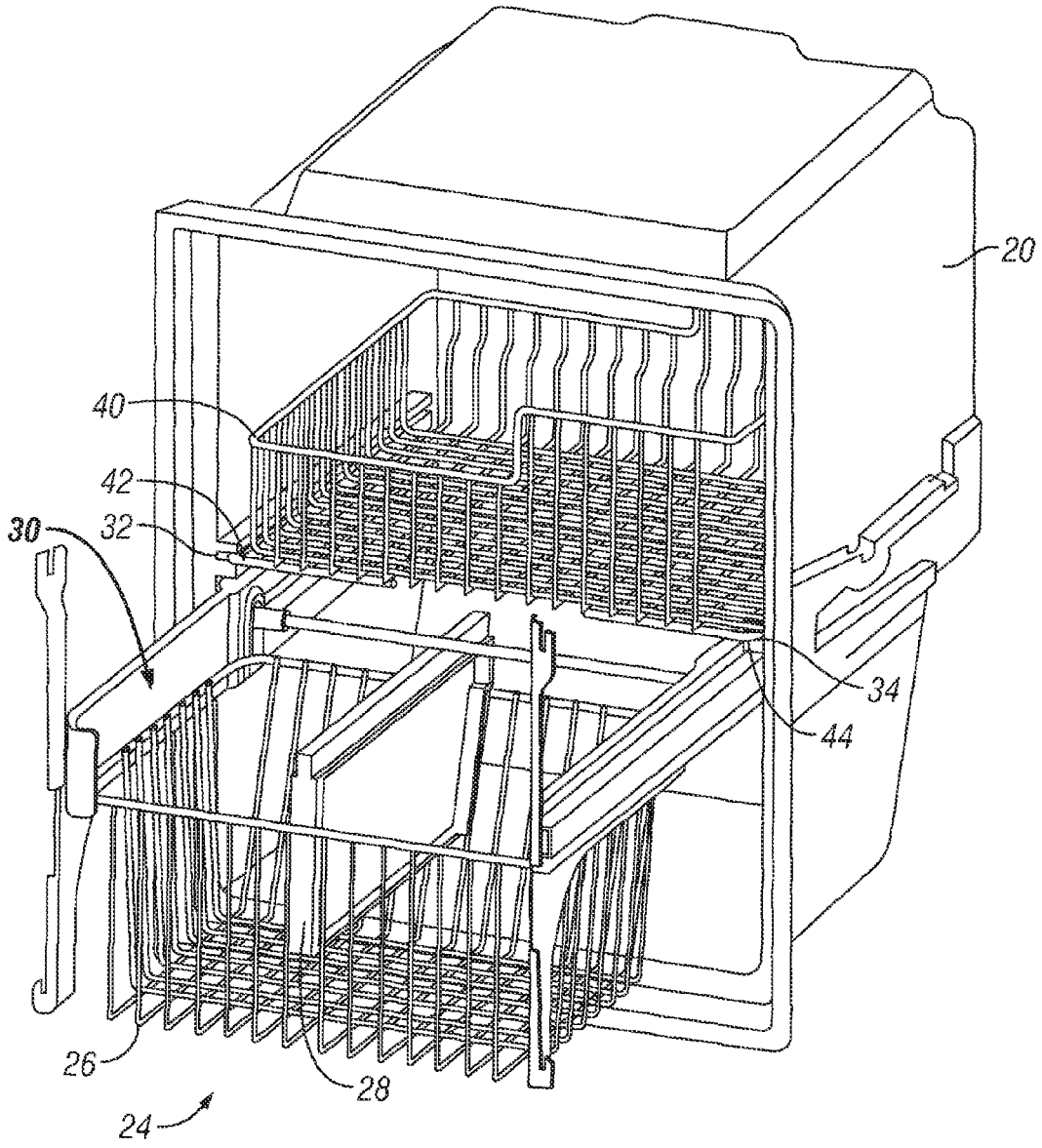
FIG. 2 is an isometric view of a lower freezer basket and an upper freezer basket located within the freezer cabinet.

As shown in FIG. 2, a freezer compartment 20 disposed within the refrigerator cabinet 12 has a lower basket 24 and an upper basket 40. Within the lower basket 24 a centrally positioned divider 28 is press fit to the lower basket 24 to divide the contents of lower basket 24. The divider 28 also provides support for the upper basket 40. The lower basket 24 may move forward and back using a rack and pinion system 30. Integrated into the left and right side mounts of the rack and pinion system 30 are u-shaped channels 32 and 42 respectively. The u-shaped channels 32 and 42 extend from the front to the rear of freezer compartment 20. The bottom surface of the upper basket 40 extends beyond its vertical structure to the left and right. The left portion and right portion of the upper basket 40 fit within the u-shaped channels 32 and 42.

Figure 3:
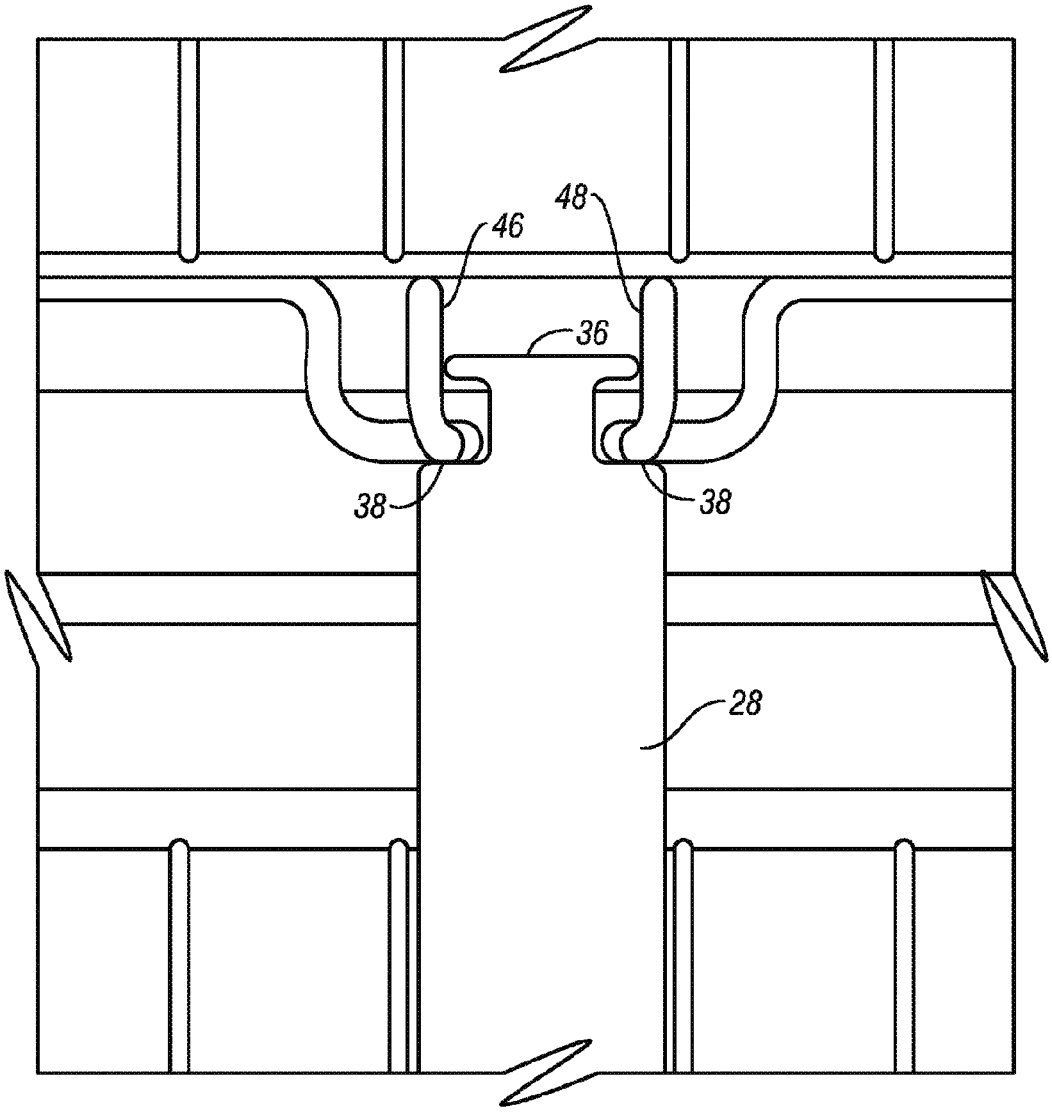
FIG. 3 is a schematic view of FIG. 2, showing the "I" beam of the lower freezer basket.

As best shown in FIG. 3, the divider 28 may have an I-beam shaped portion located on top. The divider 28 has an upper portion 36 and a lower portion 38 which creates symmetrical guide surfaces, on the left and right. The upper basket 40 has symmetrical wire form supports 46 and 48. The symmetrical wire form supports 46 and 48 are guided along the channels created by the I-beam shape atop the divider 28. The lower portion 38 of the I-beam atop the divider 28 also supports the weight of upper basket 40. Thus, in this manner, the divider 28 allows the upper basket 40 to be moved forward and backward while providing support.

Figure 4:
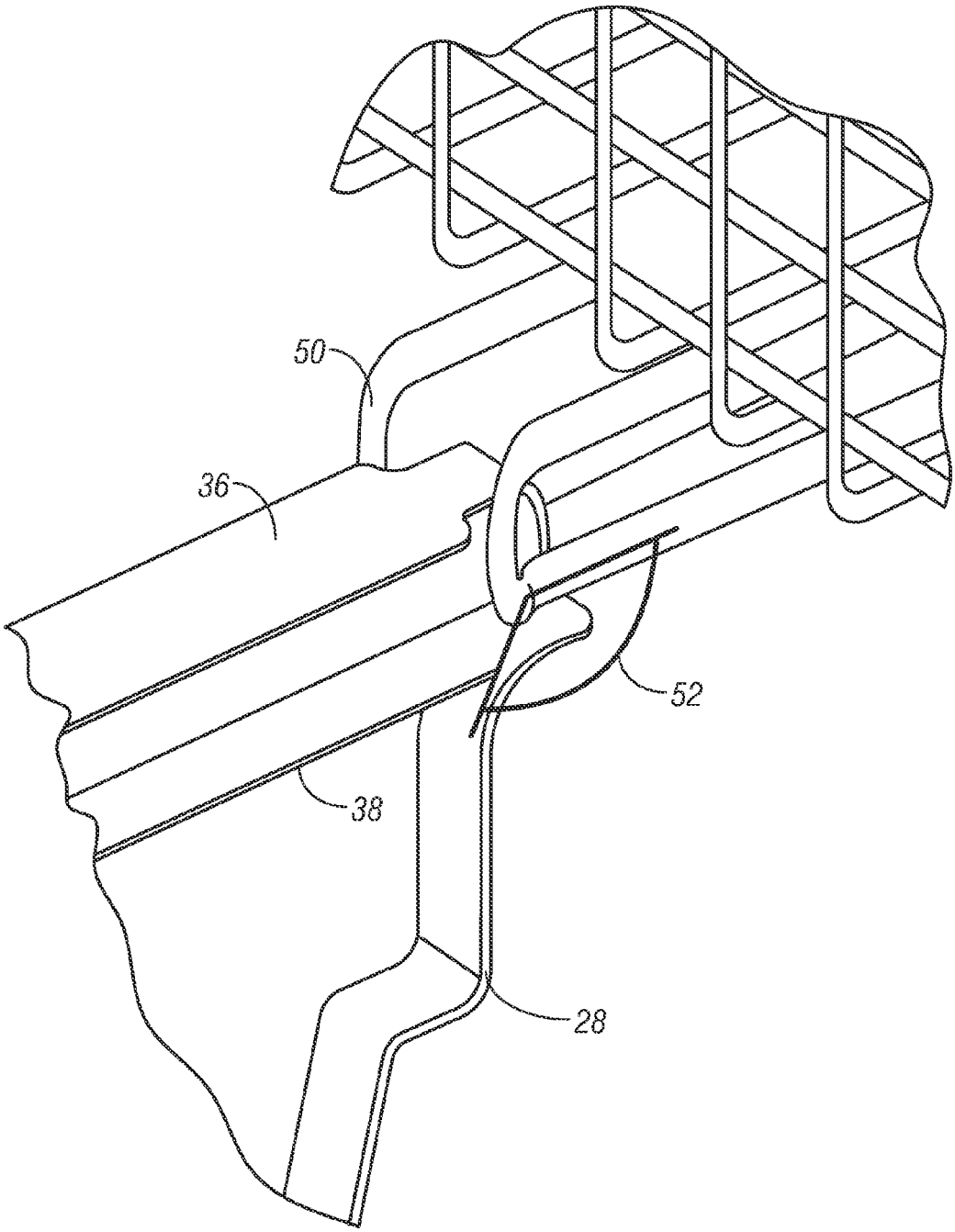
FIG. 4 is an isometric close-up view of lower basket divider and the upper basket guide surfaces.

As shown in FIG. 4, the symmetrical wire form supports 46 and 48 have a bend 50 (left) and 52 (right) which cause the upper basket 40 to lead-in into the I-beam shape atop divider 28. The lead-in bend 50 (left) and 52 (right) of symmetrical wire form supports 46 and 48 assist in preventing the upper basket 40 from being misaligned and will continually track along the I-beam shape atop divider 28.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator comprising:

a refrigerator cabinet;

a fresh food compartment disposed within the refrigerator cabinet;

a freezer compartment disposed within the refrigerator cabinet;

a freezer door for providing access to the freezer compartment;

a lower freezer basket;

an upper freezer basket;

a divider operatively connected to the lower freezer basket to divide the lower freezer basket; and guide surfaces formed in a top portion of the divider to allow for guiding the upper freezer basket forward and back, wherein the top portion of the divider is shaped as an "I" beam, wherein the upper freezer basket is a wire form basket having a first and a second lead-in bend for moving along the guide surfaces of the divider, and wherein the first lead-in bend comprises a first portion of wire running longitudinally within a slot of the "I" beam, a second portion of wire bent outward at an angle relative to the first portion of wire to clear the slot of the "I" beam, and a third portion of wire bent upward from the second portion of wire and positioned against a side of the "I" beam to thereby guide the upper freezer basket along the "I" beam.

2. The refrigerator of claim 1 wherein the lower freezer basket is a wire form basket.

3. The refrigerator of claim 1 wherein the divider is press fit to the lower basket.

4. The refrigerator of claim 1 wherein the guide surfaces include a first guide surface and a second guide surface, each of the first guide surface and the second guide surface configured to accept a respective one of the first and second lead-in bends of the wire form basket.

5. The refrigerator of claim 1 wherein the divider is centrally positioned within the lower freezer basket.

6. An assembly configured for use in a freezer compartment of a refrigerator, the assembly comprising:

a lower freezer basket;

an upper freezer basket;

a divider operatively connected to the lower freezer basket to divide the lower freezer basket; and guide surfaces formed in a top portion of the divider to allow for guiding the upper freezer basket forward and back, wherein the top portion of the divider is shaped as an "I" beam, wherein the upper freezer basket is a wire form basket having a first and a second lead-in bend for moving along the guide surfaces of the divider, and wherein the first lead-in bend comprises a first portion of wire running longitudinally within a slot of the "I" beam, a second portion of wire bent outward at an angle relative to the first portion of wire to clear the slot of the "I" beam, and a third portion of wire bent upward from the second portion of wire and positioned against a side of the "I" beam to thereby guide the upper freezer basket along the "I" beam.

7. The assembly of claim 6 wherein the lower freezer basket is a wire form basket.

* * * * *